US006094876A

United States Patent [19]

Ogo et al.

[11] Patent Number: 6,094,876

[45] Date of Patent: Aug. 1, 2000

[54] CORNER CONSTRUCTION FOR BUILDINGS HAVING STACKED TONGUE-AND-GROOVE LUMBER OR LOG CONSTRUCTION OR THE LIKE

[76] Inventors: Tatsujiro Ogo, 3-232, Mozuryonan-cho, Sakai-shi, Osaka; Kiyoshi Suzuki, 1-215, Sengen-cho, Ohniya-City, Saitama, both of Japan

[21] Appl. No.: 09/045,521

[22] Filed: Mar. 20, 1998

Related U.S. Application Data

[60] Provisional application No. 60/041,039, Mar. 21, 1997.

[51] Int. Cl.[7] ..... F04B 1/26

[52] U.S. Cl. ..... 52/233; 52/272; 446/106

[58] Field of Search ..... 52/233, 272; 446/106

*Primary Examiner*—Carl D. Friedman

*Assistant Examiner*—Phi Dieu Tran A

*Attorney, Agent, or Firm*—Todd N. Hathaway

[57] ABSTRACT

A corner joint for a structure formed of stacked timbers, such as a "log" house, and a form of timber for use in the same. The timbers may be tongue-and-groove members milled from wooden stock. The joint structure is formed by two channels which are cut vertically on opposite sides of the timber, with cutout notches being formed through the timber above and below a central tenon. The sidewalls on each vertical channel are curved, one being concave and the other convex. When assembled to form the joint, the convex sidewalls nest within the concave sidewalls so as to form a tight, stable interfit and also eliminate the direct line path which might emit light, air, or water to the interior of the building through the joint.

22 Claims, 4 Drawing Sheets

CORNER CONSTRUCTION FOR BUILDINGS HAVING STACKED TONGUE-AND-GROOVE LUMBER OR LOG CONSTRUCTION OR THE LIKE

This application claim benefit of provisional application of Ser. No. 60,041,039 filed Mar. 21, 1997.

BACKGROUND OF THE INVENTION a. Field of the Invention

The present invention relates generally to buildings which use stacked tongue-and-groove timber construction or the like, in which the lumber is stacked to form the walls of the building, and, more particularly, to a construction for corners of such buildings where the overlapping lumber members of first and second walls come together and are notched to form a corner of the structure.

b. Background

Stacked tongue-and-groove lumber and similar types of construction (e.g., log homes) are commonly used for both recreational structure and homes. In this type of construction, pieces of linear lumber (as used herein, the term "lumber" includes both milled wood and shaved and unshaved logs, as well as similar members formed of plastic or possibly other materials), stacked edge-on-edge to form the wall of the structure. Where two walls come together to form a corner, the overlapping ends of the planks or other pieces of lumber are notched (usually by being cut at the factory, but sometimes on-site) so that these form an interfitting joint structure.

In conventional construction of this type, the corner notches are ordinarily formed by a series of straight-line cuts which extend transverse to the long axis of the lumber member. This traditional form of construction leads to several problems: First, this tends to cause undesirable "light leaks", i.e., small gaps where the outside light is visible from the interior of the structure (or vice-versa). As can be seen in FIG. 3, which is a simplified schematic view of a typical prior art "straight cut" corner joint 01, this is because the structure of the straight-cut notch provides a direct, line-of-sight path 02 by which light is able to enter the interior of the building, through chinks or gaps between the overlying lumber members 04*a,* 04*b,* etc. Moreover, this straight-line path provides easy access for cold air and water to also gain entry to the interior of the structure, especially during adverse weather conditions.

Because of these problems, builders of such structures often resort to the expedience of applying calking or other filling material or trim pieces in an attempt to seal the joints. This adds significantly to the cost and difficulty of construction of the structure, often to the point of rendering the structure uneconomical for certain recreational or utility applications. Moreover, the sealant material is subject to deterioration over time, both due to degradation of the material itself and due to shifting of the wooden timbers as they shrink/expand with age and changing weather conditions: as a result, such joints require periodic and expensive maintenance over the life of the structure, yet another disadvantage of such practices is the environmentally suspect nature of the calking/sealant compounds which are commonly used for this purpose.

Yet another problem with conventional, "straight-cut" corner joints is that these ordinarily do not provide a rigid, stable junction, but tend to allow the members to shift back and forth in both longitudinal and lateral directions. This problem results both from the geometry of the "straight-cut" notched joints, and the inability of these joints to compensate for the loose manufacturing tolerances which are a practical necessity when working with wood products. As a result, conventional buildings of this type (unless very small) ordinarily require extensive internal bracing to ensure a rigid structure. The bracing typically takes the form of beams, trusses, or similar supports, and again adds greatly to the cost and complexity of the structure.

Accordingly, there exists a need for a corner structure for use in stacked tongue-and-groove lumber buildings or the like which eliminates any direct, line-of-sight path between the exterior and interior spaces of the building, so as to prevent any light leaks and remove any straight-line paths by which air/water may enter the interior of the building. Furthermore, there exists a need for such a corner structure which is air tight fitting and has a geometry which provides a stable joint despite loose tolerances in the manufacture of the members, so as to provide a rigid structure without requiring extensive internal beams or other bracing. Still further, there exists a need for such a corner joint structure which is economical to produce when using readily available stock lumber as the starting material.

SUMMARY OF THE INVENTION

The present invention provides a form of corner joint for use in a structure formed of stacked timber members which intersect at the joint.

Broadly, the corner joint structure comprises: first and second timber members having channel portions formed therein, the channel portion in the second timber member being configured to interfit in engagement with the channel portion in the first, the channel portion in the first timber member comprising at least one sidewall portion which is generally concave about a vertical axis and the channel portion in the second member comprising at least one sidewall portion which is generally convex about a vertical axis, the convex sidewall portion being configured to nest within the concave sidewall portion so as to substantially eliminate any straight line gap in a horizontal direction through the joint.

Each channel portion may comprise first and second sidewall portions, the first sidewall portion being generally concave about a vertical axis and the second sidewall portion being generally convex about a vertical axis. There may be first and second such channel portions which extend parallel to one another on opposite sides of the timber member. The channel portions may have a reversed orientation, so that the concave sidewall portion of the first channel portion is positioned towards a first end of the timber member, and the concave sidewall portion of the second channel portion is positioned towards an opposite end of the timber member.

The corner joint structure may further comprise: upper and lower notch portions which extend in a generally transverse direction through the timber member from the first channel portion to the second, above and below a central tenon portion, so as to enable the joint portion to receive joint portions of timber members tacked above and below the first member.

Each sidewall portion of the channel portions may have a generally smooth surface, and this may have a generally cylindrical curvature about a vertical axis. Each of the sidewall portions may have a substantially identical radius of curvature about its vertical axis.

The timber members may be wooden timber members, such as milled wooden members. These may be tongue-and-groove members comprising: a tongue portion extending along a top edge of the timber member, and a groove portion extending along a bottom edge of the timber member.

The present invention also provides a timber member for forming a corner joint in a structure formed of stacked timber members which intersect at the corner joint. Broadly, the timber member comprises at least one channel portion formed in the timber member, the channel portion being configured to interfit in engagement with a corresponding channel portion in a second timber member, the channel portion comprising at least one sidewall portion which is generally convex about a vertical axis and which is configured to nest within at least one sidewall portion of a corresponding channel in the second timber member which is generally concave about the vertical axis, so as to substantially eliminate any straight line gap in a horizontal direction through the joint.

DETAILED DESCRIPTION

Figure 1:
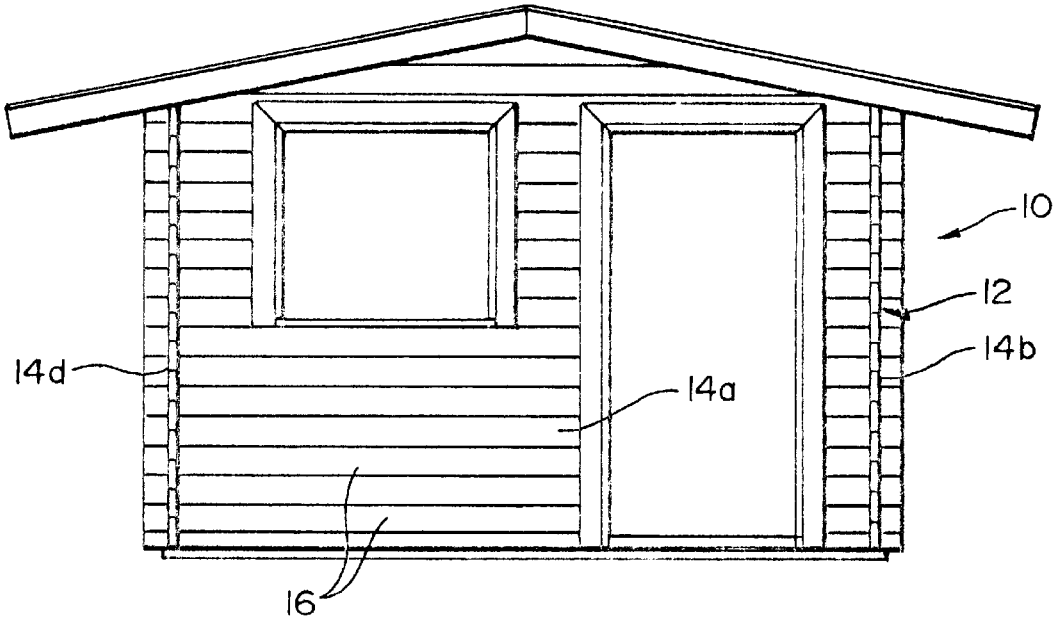
FIG. 1 is a front elevational view of a small tongue-and-groove lumber building having corner joint structures in accordance with the present invention.
Figure 2:
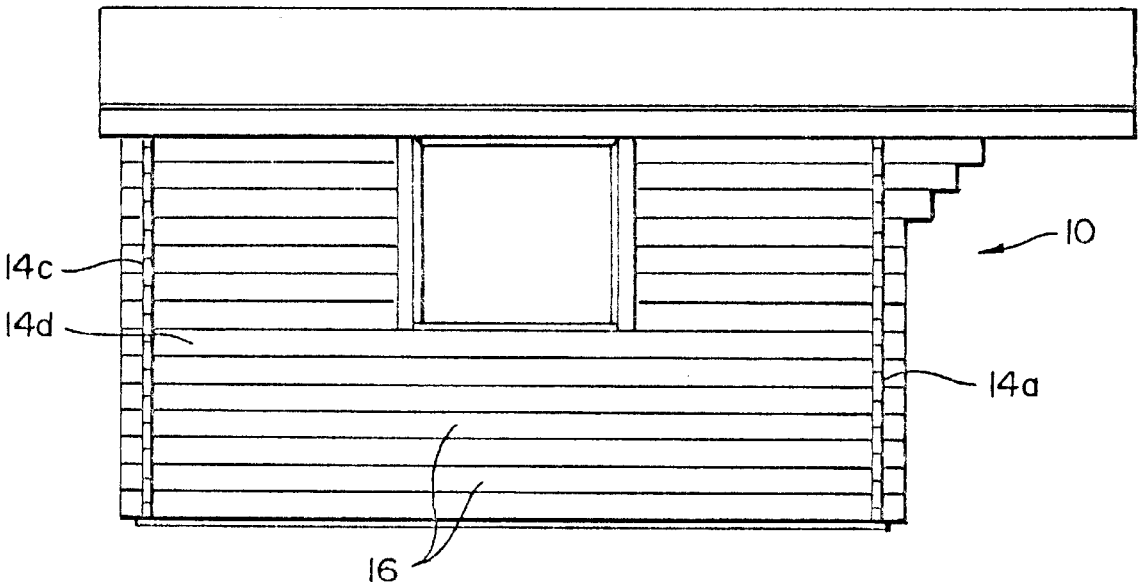
FIG. 2 is a side elevational view of the building of FIG. 1.
Figure 3:
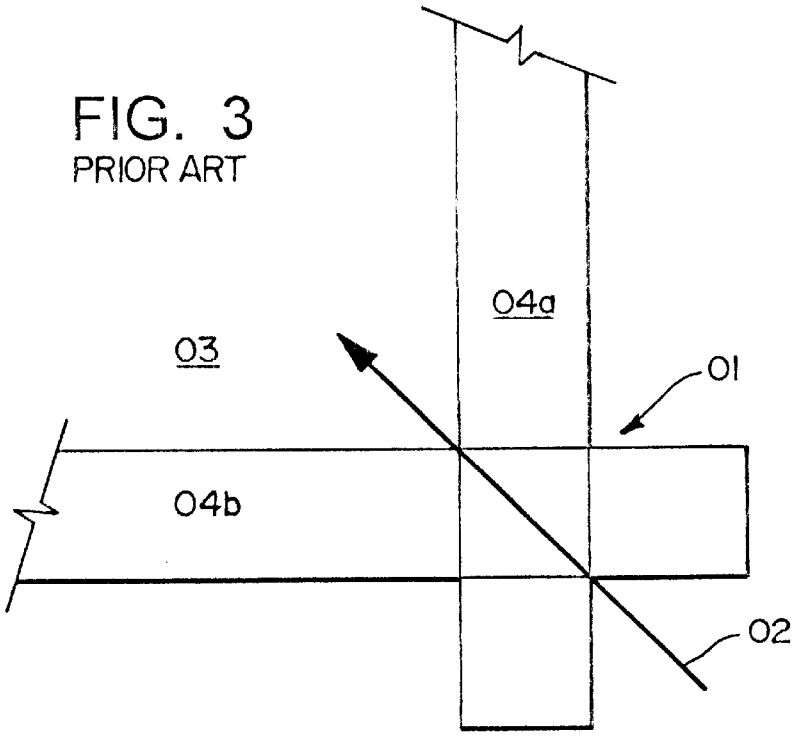
FIG. 3 PRIOR ART
FIG. 3 is a simplified schematic view of a prior art, "straight cut" corner joint, showing the straight-line path therethrough which allows leakage of exterior light, air, and water to the interior of the building.

FIGS. 1–2 show a small building 10 having a grooved lumber construction which incorporates the corner structure 12 in accordance with the present invention; as will be described in greater detail below, the corner structure is formed at the juncture of first and second walls 14*a,* 14*b,* etc. of the building, between the overlapping ends of the grooved planks 16.

Figure 6:
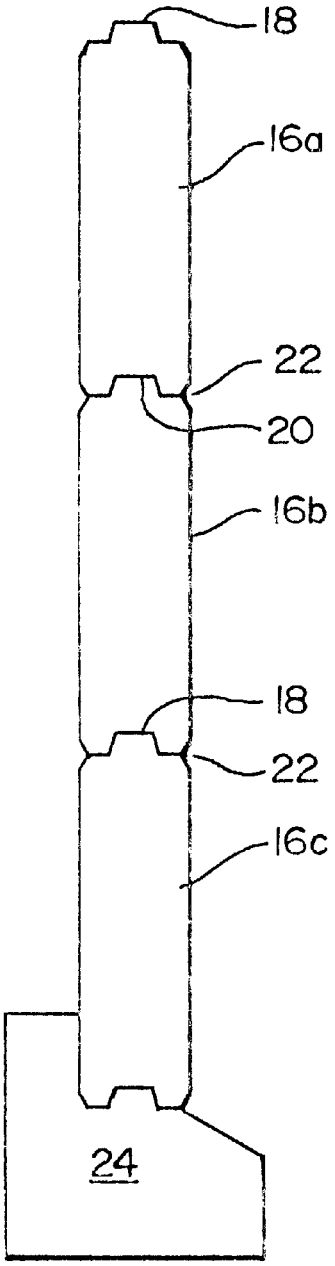
FIG. 6 is an end view of the grooved lumber members of the building of FIGS. 1–2 and which incorporate the notched corner structure as shown in FIGS. 4–5B, showing the edge-to-edge stacked relationship by which these form a wall of the building.

As can be seen more clearly in FIG. 6, each of the walls is constructed of a series of the planks 16*a,* 16*b,* 16*c* . . . , stacked in edge-to-edge engagement so that the protruding tongue 18 of each timber member is received in and engages the corresponding groove in its adjacent partner. The planks 16 or other timber members are preferably arranged with their tongue portions upwardly and the grooves downwardly, so as to help prevent entry of water through the joints 22. The lowermost timber member 16*c* preferably rests atop a footing member 24 which provides underlying support for the wall.

The present invention is eminently suited to use with timber members formed of wood, however it may also be used with longitudinal members formed of plastic, fiberglass, synthetic wood, concrete, or other materials suitable for use in building construction. Accordingly, for purposes of convenience, it will be understood that the terms "timber" and "timber member" as used herein include all such elongate structural members formed of whatever material, milled or unmilled.

Figure 7:
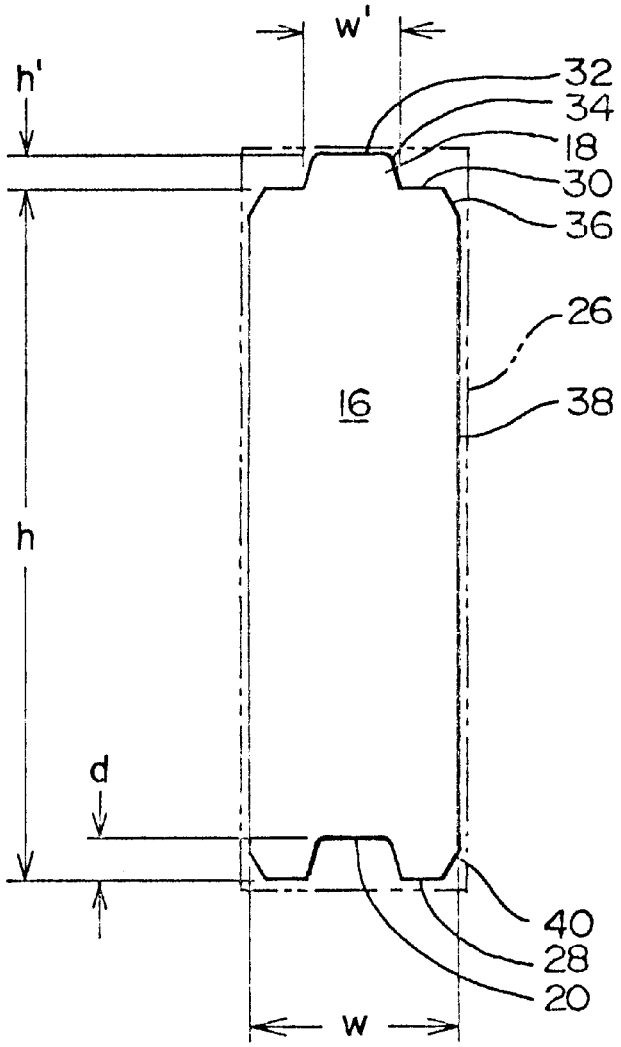
FIG. 7 is an end view of one of the grooved lumber members of the wall shown in FIG. 6, with a dotted outline showing the profile of the raw lumber member from which this piece is milled.

For purposes of illustrating the present invention, a cross-sectional view of an exemplary wooden lumber member 16 having suitable dimensions is shown in FIG. 7, to which the exemplary dimensions given in this description will relate. It will be understood, however, that the exemplary member is shown only for the purpose of illustrating a preferred embodiment of the invention, and that the present invention may consequently be used with timber members having other suitable dimensions; moreover, some of the parameters given with regard to suitable depths, radii, and other features of the joint structure relate primarily to the use of commonly available wood materials (e.g., fir, hemlock, etc.) for the lumber members, and these figures may consequently vary significantly from the exemplary values given herein if materials having different strengths or other characteristics are employed.

Accordingly, FIG. 7 shows an exemplary wooden lumber member 16 which is milled from nominal 2"×6" (40 mm×140 mm) raw stock (as indicated by dotted outline 26), such as 2"×6" fir, hemlock, or cedar, for example. The raw stock is milled to provide a height "h" equal to approximately 130 mm from the bottom 28 of the member to its upper edge 30, at the base of the upwardly protruding tongue portion 18. The overall width "w" of the exemplary mill member 16 is approximately 38 mm, and the overall width "w'" and height "h'" of the upwardly protruding tongue portion 18 are approximately 18 mm and 7mm, respectively. The tongue portion 18 tapers to a width of approximately 2 mm radius edges 34 where this meets the sloped sides of the tongue portion. 3 mm×5 mm chamfers 36 are formed along the upper edges of the outer surfaces 38 of the milled member, where these transition inwardly toward the tongue portion.

There are corresponding chamfers 40 at the bottom of the member which taper inwardly towards the area of the groove 20. A profile of the groove 20 is the same as that of the tongue portion 18, except that the depth "d" is preferably approximately 1 mm greater than the height "h'" of the tongue portion, i.e., approximately 8 mm deep in the embodiment which is illustrated.

The vertical notch 44 which forms the interlocking joint structure 12 is cut a suitable distance back from the end 46 of the lumber member 16. As can best be seen in the top view of FIG. 5A, the notch 44 is formed by first and second channels 50*a,* 50*b* formed in the opposite faces 52*a,* 52*b* of the plank member 16. Although the depth of the channels 50*a,* 50*b* may vary somewhat depending on the type of material employed and other design considerations, for most commonly available wood materials, the depth of each channel is preferably about one-fourth of the overall thickness of the plank 16 or other lumber member; this leaves a vertical web portion 54 having a thickness approximately equal to one-fourth that of the total thickness of the plank member, so as to provide a sufficiently strong connecting piece between the two parts of the plan member on either side of the cut.

Rectangular upper and lower cutouts 66*a,* 66*b* are formed above and below the connecting web 54 of the notch structure. The depth of each of the cutouts 66 is approximately one-quarter of the full depth of the plank member 16, and the width (w" in FIG. 5B) is approximately equal to (preferably, just slightly larger than) the width of the web portion 54 of the plank members, i.e., approximately 20.00 mm in the embodiment which is illustrated. (The depth of the upper notch 66*a* being measured from the upper edge 30 of the plank member, rather than the top of the tongue portion 18 which is received in the groove portion of the adjoining member.)

Figure 4:
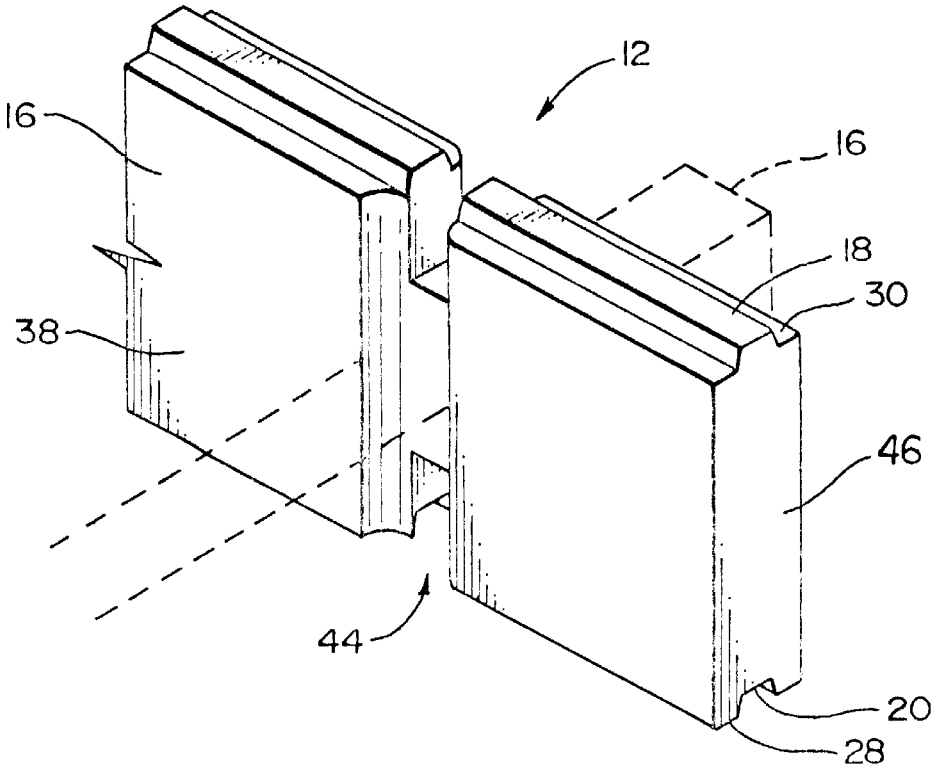
FIG. 4 is a perspective view of a corner notch structure in accordance with the present invention, as used in the exemplary building of FIGS. 1–2.

The full width of the notch structure 44, between the side edges 70, 72 of the curved edge surfaces, is approximately equal to and preferably just slightly larger than the full width of the plank members themselves, i.e., approximately 40.00 mm in the embodiment which is illustrated. This allows the end pieces of the plank members to interfit as shown in FIG. 4, with the upper edge of the lower transverse member meeting the lower edge of the upper transverse member at approximately the midpoint of the web 54, as indicated by dotted line 74. The combined depth of the two cutout portions 66*a,* 66*b* is preferably just slightly larger than the depth of web 54, so as to allow for production tolerances and still ensure a tight joint between vertically adjoining cross-members; for example, in the embodiment which is illustrated, the depth of each of the cutouts 66*a,* 66*b* is preferably about 33 mm, leaving a web approximately 64 mm high (i.e., the depth of the web is approximately 2 mm less than the combined depth of the two notches).

Figure 5A:
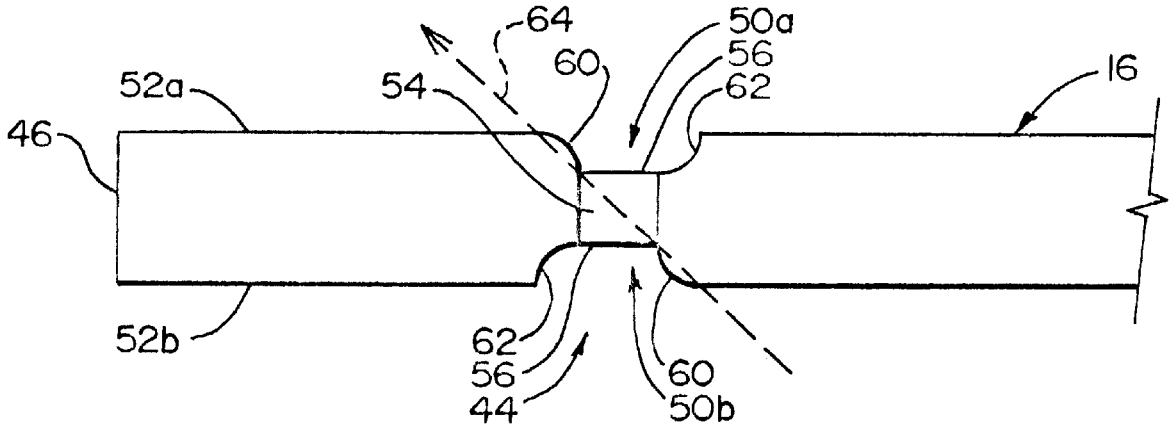
FIG. 5A is a plan view of the notch structure of the present invention which is shown in FIG. 4.
Figure 5B:
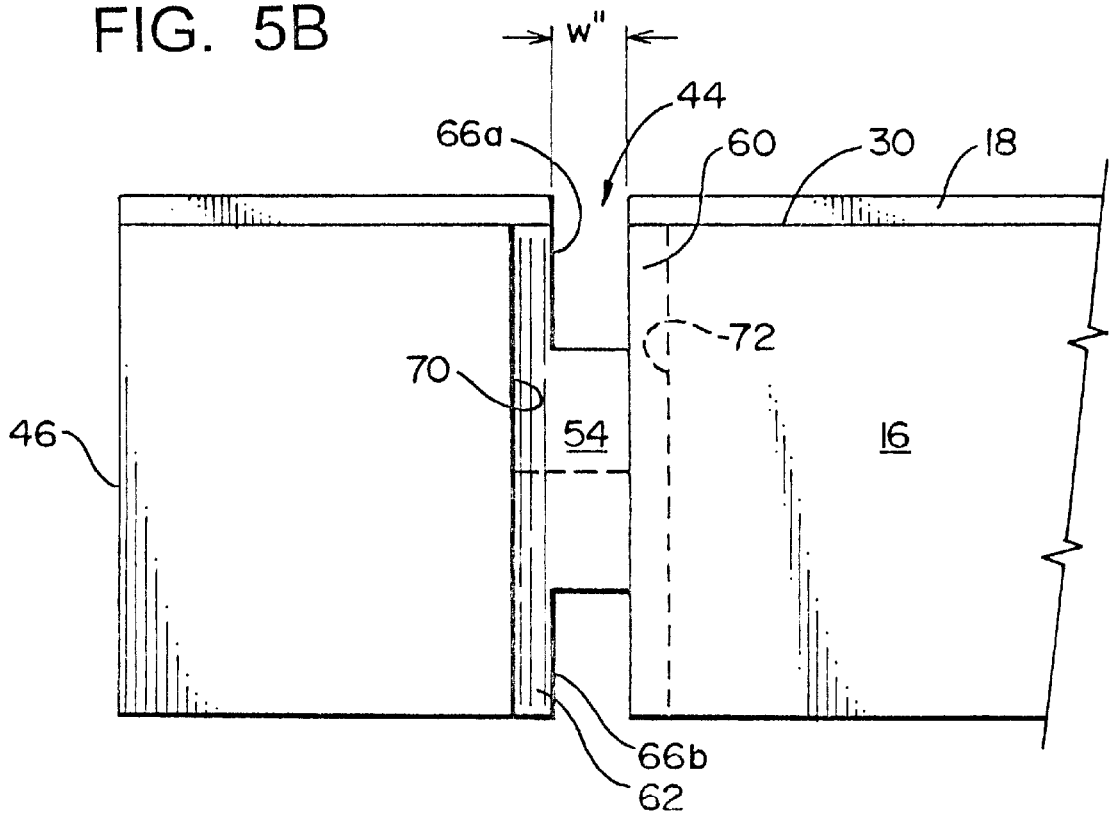

As can also be seen in FIG. 5A, each of the channels 50*a,* 50*b* is formed with a flat base surface 56, which extends generally parallel to the outer faces 52*a,* 52*b* of the plank member, and a strongly convex edge surface 60 along one side, and a corresponding concave edge surface 62 along the other. The two channels 50*a,* 50*b* are formed such that the arrangement of these surfaces is "reversed" on opposite sides of the plank member, i.e., (as can be seen in FIG. 5A) the convex edge surface of the first channel 50*a* will be disposed towards the outer end 46 of the plank member, while the convex edge surface 62 of the other channel 50*b* will be disposed towards the end of the member.

This arrangement serves to position corresponding convex—convex and concave—concave edge surfaces along a line from corner to corner in the joint structure, thereby serving to eliminate any straight-line path through the joint, as indicated by dotted line arrow 64 in FIG. 5A. Because of the elimination of any direct line-of-sight path through the joint structure, the present invention is able to completely eliminate any light leaks at the corners of the structure. Moreover, the labyrinthine configuration of the joint serves to impede the entry of cold air and water into the interior of the building, although in some embodiments, especially in structures built in sever climates, the owner may wish to add a bead of calking to make the joint entirely air/water tight.

Furthermore, in addition to blocking the entry of light and air/water through the joint, the corner structure of the present invention provides a tight, stable interfit between adjoining plank members, as shown in FIG. 4. In particular, the flat base surfaces 56 of the channels provide stability against relative movement between the members in the directly longitudinal and lateral directions, whereas the engagement of the four curved edge surfaces 60, 62 provides resistance to movement in other directions. This strong, stable interfit which is provided by the present invention thus makes it possible to eliminate much of the interior bracing which is required by structures having more conventional construction.

As was noted above, a key aspect of the present invention are the convex-concave surfaces 60, 62 at the edges of each of the channels 50 cut in the ends of the plank members. For most types of construction using wood material, a suitable radius of material for each of these curved surfaces is approximately 8 mm; if the radius is too small (for example, possibly in the range of 3 mm using some wood materials), then there would not be sufficient curvature to ensure that the light/leakage path is blocked, especially in view of manufacturing variations and the shrinkage/expansion of the wood material over time; on the other hand, if a much larger radius of curvature is used, then this may reduce the thickness of the web portion 54 to the point where the member becomes unacceptably weak.

Also, it should be recognized that the cylindrically curved edge surfaces 60, 62 of the illustrated embodiment of the invention provide many advantages, including the ease of manufacture by simply running a router down the edges of the channels 50, that surface having other degrees/types of curvature (e.g., a ellipsoid curve) or possible polygonal geometries may be used in some embodiments and are therefore within the scope of the present invention. Still further, it will be understood that in some embodiments there may be only one channel or one pair of interfitting convex/concave walls (rather than the complete structure which has been disclosed in the exemplary embodiment), especially in those embodiments where reversibility or interchangeability of the timber members is not a requirement.

It is to be recognized that various alterations, modifications, and/or additions may be introduced into the constructions and arrangements of parts described above without departing from the spirit or ambit of the present invention as defined by the appended claims.

What is claimed is:

1. A corner joint for a structure formed of stacked timber members which intersect at said corner joint, said corner joint comprising:

a first timber member having a channel portion formed therein; and a second said timber member having a channel portion formed therein, said channel portion in said second timber member being configured to interfit in engagement with said channel portion in said first timber member;

said channel portion in said first timber member comprising at least one sidewall portion which is generally concave about a vertical axis, and said channel portion in said second timber member comprising at least one sidewall portion which is generally convex about a vertical axis;

said generally convex sidewall portion being configured to nest within said generally concave sidewall portion so as to substantially eliminate any straight line gap in a horizontal direction through said joint.

2. The corner joint of claim 1, wherein each said channel portion comprises:

first and second sidewall portions, said first sidewall portion being generally concave about a vertical axis and said second sidewall portion being generally convex about a vertical axis.

3. The corner joint of claim 2, wherein each said timber member comprises:

first and second said channel portions which extend parallel to one another on opposite sides of said timber member.

4. The corner joint of claim 3, wherein said first and second channel portions in each timber member are oriented in a reversed relationship, so that said concave sidewall portion of said first channel portion is positioned towards a first end of said timber member and said concave sidewall portion of said second channel portion is positioned towards an opposite end of said timber member.

5. The corner joint of claim 4, further comprising:

upper and lower notch portions which extend in a generally transverse direction through said timber member from said first channel portion to said second channel portion, above and below a central tenon portion, so as to enable said channel portions to receive channel portions of timber members stacked above and below each said timber member.

6. The corner joint of claim 2, wherein each said sidewall portion has a generally smooth surface which is curved about said vertical axes.

7. The corner joint of claim 6, wherein each said sidewall portion has a generally cylindrical curvature about said vertical axes.

8. The corner joint of claim 7, wherein each said sidewall portion has a substantially identical radius of curvature about said vertical axes.

9. The corner joint of claim 1, wherein said timber members are wooden timber members.

10. The corner joint of claim 9, wherein said timber members are milled wooden members.

11. The corner joint of claim 1, wherein said timber members are tongue-and-groove members, each said timber member comprising:

a tongue portion extending along a top edge of said timber member; and a groove portion extending along a bottom edge of said timber member.

12. A timber member for forming a corner joint in a structure formed of stacked timber members which intersect at said corner joint, said timber member comprising:

at least one channel portion formed in said timber member, said channel portion being configured to interfit in engagement with a corresponding channel portion in a second timber member, said channel portion comprising at least one sidewall portion which is generally convex about a vertical axis and which is configured to nest within at least one sidewall portion of said corresponding channel portion of said second timber member which is generally concave about a vertical axis, so as to substantially eliminate any straight line gap in a horizontal direction through said joint.

13. The timber member of claim 12 wherein each said slot portion comprises:

first and second sidewall portion, said first sidewall portion being generally concave about a vertical axis and said second sidewall portion being generally convex about a vertical axis.

14. The timber member of claim 13, wherein said timber member comprises:

first and second said channel portions which extend parallel to one another on opposite sides of said timber member.

15. The timber member of claim 14, wherein said first and second channel portions in said timber member are oriented in a reversed relationship, so that said concave sidewall portion of said first channel portion is positioned towards a first end of said timber member and said concave sidewall portion of said second channel portion is positioned towards an opposite end of said timber member.

16. The timber member of claim 15, further comprising:

upper and lower notch portions which extend in a generally transverse direction through said timber member from said first channel portion to said second channel portion, above and below a central tenon portion, so as to enable said channel portions to receive channel portions of timber members stacked above and below each said timber member.

17. The timber member of claim 13, wherein each said sidewall portion has a generally smooth surface which is curved about said vertical axes.

18. The timber member of claim 17, wherein each said sidewall portion has a generally cylindrical curvature about said vertical axes.

19. The timber member of claim 18, further comprising:

a tongue position extending along a top edge of said timber member; and a groove portion extending along a bottom edge of said timber member.

20. The timber member of claim 19, wherein said timber member is a milled wooden member.

21. The timber member of claim 12, wherein said at least one channel portion is positioned proximate an axial end of said timber member.

22. A timber member for forming a corner joint in a structure formed of stacked timber members, said timber member comprising:

a wooden member having a vertically elongate, generally rectangular cross-section;

a tongue portion along a top edge of said wooden member and a groove portion extending along a bottom edge of said wooden member; and a joint portion extending across said wooden member, said joint portion comprising:

first and second channels which extend vertically and parallel to one another on opposite sides of said wooden member each said channel comprising a first sidewall portion which is generally cylindrically convex about a vertical axis and a second sidewall portion which is generally cylindrically concave about a vertical axis:

said channels having an orientation which is reversed from one another so that said convex sidewalls portion of said first channel is positioned towards a first end of said wooden member and said convex sidewall portion of said second channel is positioned towards an opposite end of said wooden member;

first and second channels further being of substantially equal depth and said sidewall portions thereof all having substantially identical radii of curvature about said vertical axes; and first and second notch portions which extend horizontally and parallel to one another, from said first channel to said second channel above and below a central tenon portion of said wooden member;

said joint portion being configured to receive joint portions of corresponding timber member above and below said wooden member in interfitting engagement therewith, so as to form a corner joint between said members, and so that said convex wall portions nest within said concave wall portions so as to eliminate substantially any direct line path in a horizontal direction through said corner joint.

* * * * *